United States Patent [19]

Rausing

[11] Patent Number: 4,944,408

[45] Date of Patent: Jul. 31, 1990

[54] OPENING ARRANGEMENT FOR CARDBOARD PACKAGE

[75] Inventor: Hans Rausing, Wadhurst Park, England

[73] Assignee: Tetra Pak Holdings & Finance S.A., Pully, Switzerland

[21] Appl. No.: 436,717

[22] Filed: Nov. 15, 1989

[30] Foreign Application Priority Data

Nov. 16, 1988 [GB] United Kingdom ..... 8826750

[51] Int. Cl.[5] ..... B65D 5/70

[52] U.S. Cl. ..... 206/628; 206/603; 206/620; 220/270; 220/277

[58] Field of Search ..... 206/603, 620, 628, 633; 220/266, 269, 270, 277, 345, 346; 222/541, 561, 566

[56] References Cited

U.S. PATENT DOCUMENTS

| | | | |
|---|---|---|---|
| 1,639,759 | 8/1927 | Whelan | 206/603 |
| 4,289,250 | 9/1981 | Jordon | 220/269 |
| 4,634,008 | 1/1987 | Ströle et al. | 206/620 |
| 4,732,277 | 3/1988 | Smith | 206/633 |
| 4,779,793 | 10/1988 | Runo et al. | 220/345 |
| 4,819,829 | 4/1989 | Rosten et al. | 220/346 |
| 4,838,428 | 6/1989 | Rausing | 220/90.4 |

*Primary Examiner*—Gary Elkins

*Attorney, Agent, or Firm*—Burns, Doane, Swecker & Mathis

[57] ABSTRACT

A cardboard/plastics film laminate package (1) is provided with an opening arrangement consisting of a channel (6) fixed to the top wall of the package over an opening area (4) bounded by a tearing line (3) part thickness perforations and an opening element (9). The opening element (9) is a strip having a pull-tab (10) at one end and a bent back penetrating portion (11) fixed at (14) to a part (14'') of the opening area. On pulling the tab (10), the penetrating portion (11) wedges between the channel (6) and the opening area of the package and is forced to penetrate the opening area. On further pulling, the opening area of the package is torn away and removed through the channel (1) which then forms a pouring mouth.

9 Claims, 5 Drawing Sheets

OPENING ARRANGEMENT FOR CARDBOARD PACKAGE

The present invention relates to an opening arrangement for a cardboard package of the type which has a package wall comprising a base layer of paper or cardboard having coatings of thermoplastic material on both sides and a tearing indication provided in the package wall enclosing at least parts of the desired opening area.

It is a known and frequently occurring feature in packing technology for non-returnable packages to be manufactured from plastic-coated cardboard material. The problem is, and has been, to create an effective opening arrangement which operates well and which at the same time is easy to apply and use and is not too expensive. A common solution consists in providing the package wall with a tearing indication which most frequently is in the form of a perforation going through the base material of cardboard, but not through the inner plastic layer, at least not when the opening arrangement is used for a liquid package. With the help of such a perforation an opening area can be defined and through direct tearing, use of so-called pull-tabs, or in some other manner a part of the package wall within the opening area can be removed or taken off so as to render the contents accessible.

Another requirement made on an opening arrangement is that it should be possible in an easy and controllable manner to pour out the contents of the package through the opening, this being especially important in the case of liquid packages. It has been attempted previously through the application of pouring edges, ducts or in some other manner to create preconditions for a good pouring capacity of the package. As an example of such an opening arrangement may be mentioned Swedish patent No. 324 535 which discloses a liquid package of cardboard material, on the upper side of which has been provided an opening where a part of the package wall is removed with the help of a pull-tab, and at the same time a pouring channel is formed from the emptying hole to the edge of the package in conjunction with the removing of the pull-tab. In this connection reference may be made also to European patent application No. 88100573.0 which discloses a liquid package whose upper side has been provided with a duct or pouring channel wherein is arranged a pull-out means which is provided with pointed portions directed downwards which, as the means is pulled out of the duct, will cut through the packing container and create an opening which is widened when the said means is pulled from the pouring channel owing to its pointed parts "ploughing" a longitudinal opening into the package wall.

The present invention is a development of the opening arrangement just mentioned and relates to cardboard packages of the type having a tearing indication provided in the package wall enclosing at least parts of the desired opening area. The characteristic of the opening arrangement and package in accordance with the invention is that it comprises on the one hand a duct or pouring channel fixed to the said package wall, this pouring channel surrounding the said opening area so as to cover it, on the other hand a pull-out opening means arranged in the said pouring channel partially projecting from it and comprising parts which are inclinable in relation to the principal direction of the means and which are adapted so that with their one boundary edge they rest against, and are fixed to, the said opening area adjoining the tearing indication which delimits the opening area, and that the said opening means is adapted so that when a traction force is exerted onto the opening element substantially parallel with the longitudinal direction of the pouring channel, the said inclinable parts will be pressed in inclined position against the inside of the pouring channel and exert a pressure directed substantially against the package wall within the parts of the opening area where the said inclinable parts of the opening means are fixed, with the object of breaking up the said tearing indication and, on continued pulling out of the opening means from the pouring channel, remove the wall part or parts of the package wall present within the opening area after tearing up of the said tearing indication.

Some embodiments of the present invention will be described in the following with reference to the attached schematic drawing, wherein FIG. 1 shows a so-called exploded view of the upper part of a package provided with an opening arrangement in accordance with the invention.

FIG. 2 shows a partly cut-through opening arrangement of the same type as that shown in FIG. 1.

FIG. 3*a, b, c* and *d* show schematically how a package is opened with the help of the opening arrangement in accordance with the invention.

Figure 1:
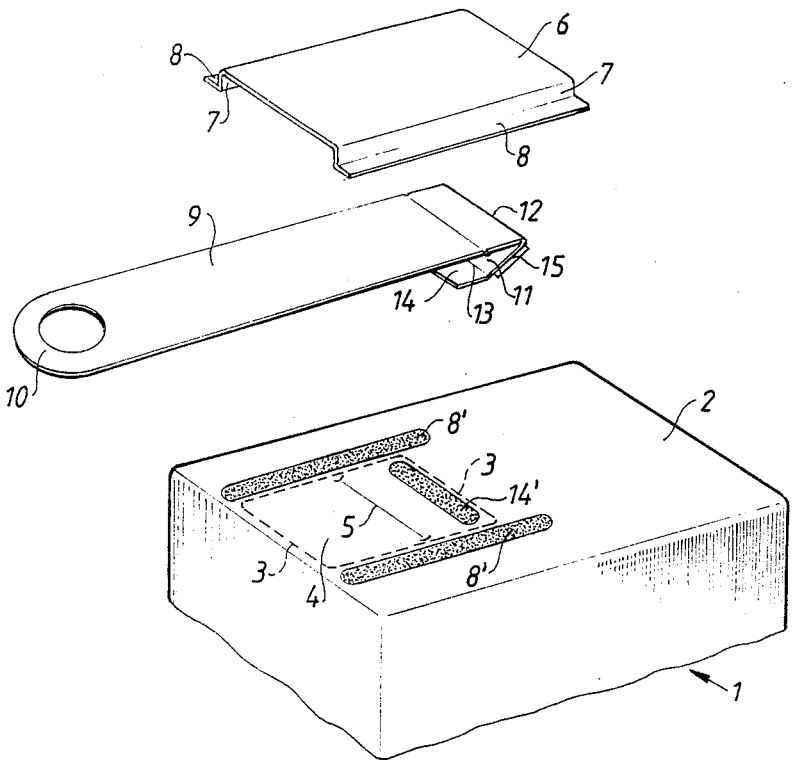

In the following two embodiments of the opening arrangement in accordance with the invention will be described and the first of these embodiments is shown in FIG. 1, wherein a packing container which is assumed to hold liquid contents, e.g. milk, is designated by numeral 1. In the upper end surface 2 of the packing container 1 is provided a tearing perforation 3 which extends around an opening area 4. During the opening operation the package wall at the part of the upper end wall 2 of the package 1 which is designated as the opening area 4 is to be removed in that the perforation is torn up and the packing material is taken off. In the opening area 4 the package wall is provided with a crease line 5 for facilitating the bending of the package wall along the said crease line. Above the opening area 4 is arranged a duct or pouring channel 6 of a substantially U-shaped cross-section (the pouring channel 6 also, advantageously, may be tubular at the parts of the pouring channel which project over the lateral edge of the package 1 so that a sharp pouring edge will be formed). The said duct or pouring channel 6 has relatively low parallel side walls 7 which at their lower edge continue into fixing flanges 8, which are intended to be attached with the help of adhesives or by means of heat-sealing to the hatched areas 8' shown on the upper end wall 2 of the package 1. In the pouring channel 6 is arranged an opening means 9 in the form of a rigid band or a strip which at its front end projecting from the pouring channel 6 has a pull-ring or a pull handle 10. The pull-strip or pull-band 9 furthermore has a folded back portion or a fold 11 which is joined hingelike to the pull-strip via a crease line 12. A fixing flange 14 for the opening means 9 is likewise in hinged connection with the folded back part 11 via a further crease line 13 which extends transversely to the opening means. The folded back part or fold 11 should be so rigid that it is not deformed to an appreciable degree when it is subjected to flexural stresses or buckling stresses, and this can be achieved either in that the opening means 9 as a whole is made of a material of great rigidity or also in that the folded back portion 11 is provided with a stiffening part 15 which is sealed to the folded back part 11. The fixing flange 14 is adapted so as to be attached to the obliquely hatched area 14' shown within the opening area 4. The attachment of the flange 14 to the area 14' may be done with the help of an optional adhesive, e.g. a heat-activatable bonding agent or by means of heat-sealing, the principal thing being that the sealing join should be so strong that it cannot easily be torn up.

Figure 2:
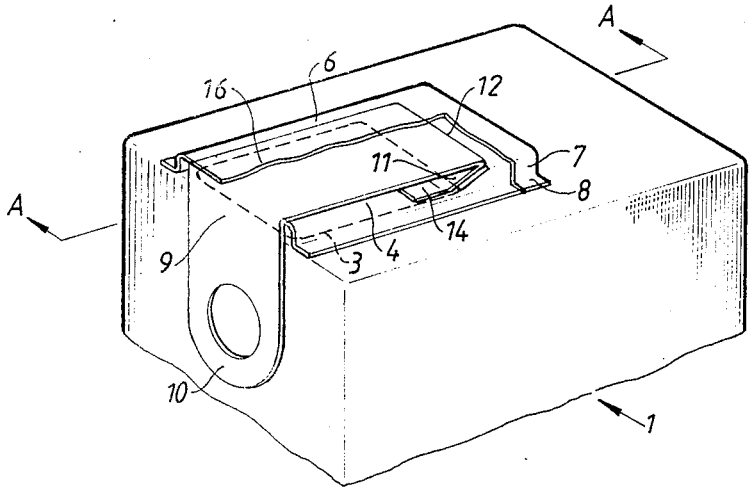

The opening arrangement shown in FIG. 1 in so-called exploded view is shown assembled in FIG. 2, where the same reference designations have been used for the different parts. It is to be noted that in FIG. 2 the pouring channel 6 is cut open along a line 16 so as to allow the assembled opening arrangement to be shown in an intelligible manner. As is further evident from FIG. 2, the front part of the pull-strip of the opening means 9 is folded down against the package side, and, preferably, is fixed to the same by means of an easily breakable bond so that the pull-strip can be made readily accessible when the package is to be opened.

Figure 3A:
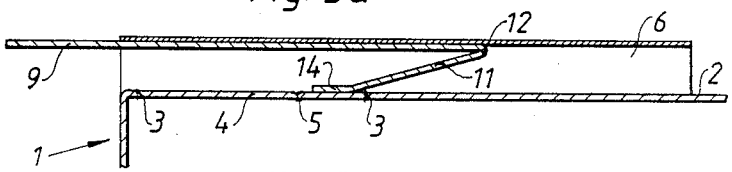
Figure 3B:
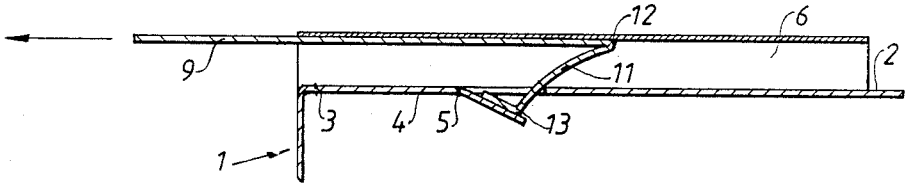
Figure 3C:
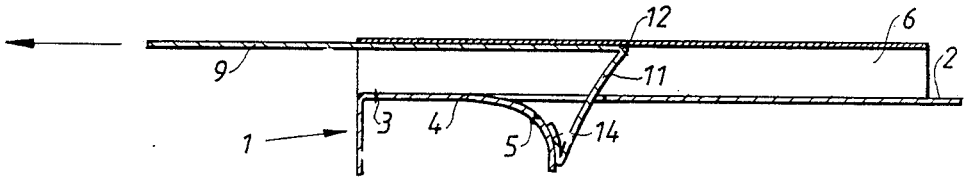

The procedure during the opening operation is evident from FIG. 3*a–d*, which show a section through a central portion of the package shown in FIG. 2, namely the section A—A. In FIG. 3*a* the opening arrangement is shown in its initial position, that is to say the pull-tab 9 has been folded up, whilst otherwise no other opening measure has been taken, which means that the perforation 3 is intact. In FIG. 3*b* a tensile force is exerted on the pull-tab 9, which results in a bending or buckling load being exerted on the folded back fold portion 11 as this portion is compressed between the upper end wall of the pouring channel 6 and the attachment 14 at the upper end wall 2 of the packing container 1. The inclinable folded back portion 11 thus will exert compressive forces on the upper end wall of the pouring channel 6 as well as on the end wall 2 of the packing container 1. Since the point of attachment 14 is arranged close to the perforation line 3 delimiting the opening area 4 a breaking force will put a stress on parts of the perforation line 3 which in the manner as shown in FIG. 3*b* is torn up and parts of the opening area 4 will be pressed down into the packing container 1 with the help of the inclinable folded back portion 11. To facilitate this operation, the opening area 4 has been provided with a crease line or folding line 5. As the pulling of the opening means 9 continues the upper part of the folded back inclinable portion 11 along its folding line 12 will move along the upper end wall of the pouring channel 6 whilst the fold formed by the folded back portion 11 is gradually straightened out at the same time as a greater part of the opening area 4 is torn up along the perforation line 3 because the inclinable folded back portion 11, whilst being straightened out, will project farther and farther into the package 1.

Figure 3D:
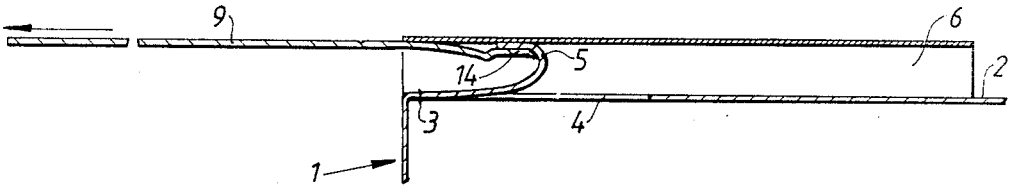

When the fold formed by the folded back portion 11 has been wholly straightened out, the opening area 4 in the upper end wall 2, in the manner as shown in FIG. 3*d*, will be fully torn out and removed when the opening means 9 is withdrawn from the pouring channel 6, since the opening means 9 is joined to the opening area 4 along the sealing area 14'. When the opening means 9 has been wholly withdrawn, and consequently the opening area 4 has been uncovered, the package is ready to be used and the contents enclosed in the package can be conveniently emptied from the pouring channel 6 through the established opening which was formed when parts of the upper end wall 2 within the opening area 4 were removed.

Figure 4:
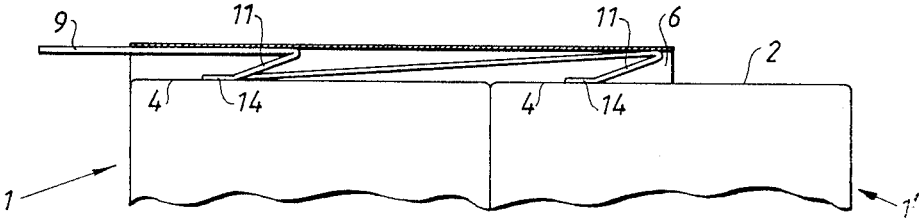
FIG. 4 shows how the opening arrangement is accordance with the invention is applied to two packing containers joined together to open them in a common operation so as to make the contents accessible.

In certain cases it is desirable to open two packing units 1 and 1' joined together or assembled at the same time, and this can be done in the manner shown in FIG. 4 where it is assumed that the two packing units 1 and 1' are placed adjoining to one another and fixed close to one another. Each of the packing units 1 and 1' is provided with an opening area 4 delimited by a perforation 3 in the manner which has been described earlier, and a pouring channel 6 is placed above the opening areas of the two packages in the manner shown in FIG. 4. The said packages as shown in FIG. 4, beside a common pouring channel 6, also have a common opening means 9 consisting of a pull-tab with two folded back folds or inclinable parts 11. The opening operation of the combined packages can take place in the same manner as described above, the opening areas 4 of both packages being uncovered when the opening means 9 is pulled out of the pouring channel 6. Because the pouring channel 6 is arranged over both the said opening areas 4, the packages 1 and 1' can be emptied in a common pouring movement. Through application of the arrangement shown in FIG. 4 it is possible in a simple manner to create packing units of varying size in that one or more standard sizes are used and these are combined subsequently to packages of he desired size. It would be possible also to use the arrangement shown in FIG. 4 in those cases where it is desirable that products enclosed in the packages 1 and 1' should be mixed only at the time of pouring.

Figure 5:
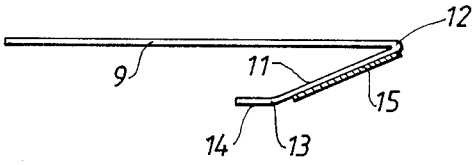
FIG. 5 shows a detail of the opening means which here is constituted of a pull-tab.

In FIG. 5 is shown an enlarge cross-section of an opening means and, as can be seen, the folded back part of the fold or inclinable part 11 is provided with a stiffening plate 15 so as to prevent buckling of the folded back part of the fold 11 when it is compressed between the upper end wall of the pouring channel 6 and the end wall 2 of the packing container 1.

Figure 6:
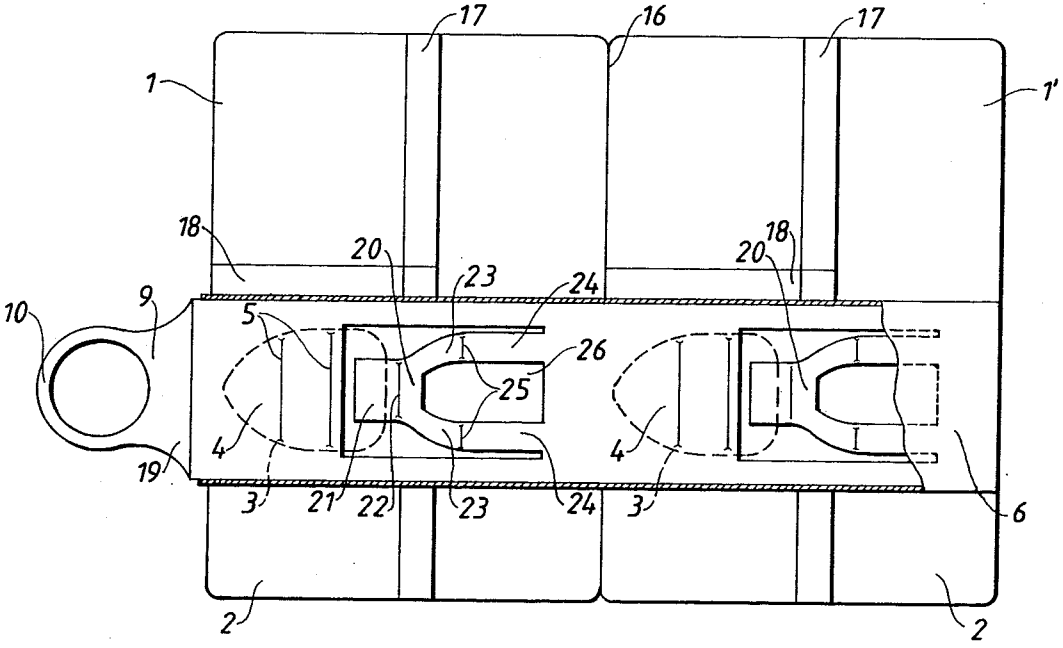
FIG. 6 shows a view from the top of an embodiment of the opening arrangement other than that shown eariler, the opening arrangement being applied to two packing containers joined together.

A further embodiment of the arrangement in accordance with the invention is shown in FIG. 6 which shows two packing units 1 and 1' which has been fixed to one another along their common end wall 16. The packages indicated here are of the type manufactured from a web which is folded to a tube. Into this are then filled the contents intended for the packages, whereafter the tube is sealed along narrow flattening zones located at a distance from one another, separated and formed to a parallelepipedic package. Such a package, on the one hand, has a longitudinal overlap joint 18 (which is the joint formed when the longitudinal edges of the web are joined to one another so as to form a tube) and upper and lower transverse joints 17 (which are the sealing joints formed when the tube is flattened and sealed along the flattened zones). The packing containers of this type, as is evident from FIG. 6, do not have any unbroken end wall, but the upper end walls 2 are divided into a number of panels which are delimited by the said sealing zones 17 and 18. In order to make an opening arrangement of the type referred to by the present invention function it is desirable, and even necessary, for the opening area 4 to be located in an end wall area which is not interrupted by sealing joints and, as can be seen, the opening areas 4 in FIG. 6 have been placed in such areas.

The opening arrangement in accordance with FIG. 6, like the embodiment described earlier, has a duct or pouring channel 6 which is fitted over the upper end walls 2 of the packages 1 and 1' joined together. In the pouring channel 6 an opening means 9 is provided. The pull-means 9 projects out beyond the pouring channel 6 with a gripping part 10 which, in the manner shown earlier, can be folded down and sealed to the side wall of the packing container 1. As in the case described earlier, the opening areas 4 within the upper end walls 2 on the packing containers 1 and 1' respectively are delimited by a tearing perforation 3 and the opening areas 4 are provided with trasnverse crease lines 5.

Figure 7:
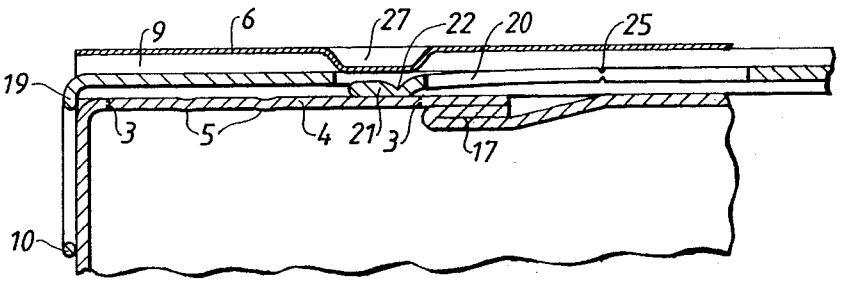
FIG. 7 shows an enlarged cross-section of one of the opening areas shown in FIG. 6.

The opening arrangement in FIG. 6 differs, though, from that shown and described earlier in that the pull-means 9 is not constituted of a strip but of a relatively rigid part which has been injection moulded, or punched out of a plastic plate, whose front end 19 projects outside the pouring channel 6 and is provided with a gripping part 10. The opening means or pull-means 9 is provided, moreover, with two punched-out tonguelike parts 20 which constitute the inclinable parts in the pouring channel 6. The punched-out tongues 20 have a front fixing part 21 which via a hinge or folding line 22 is joined to the middle portion of the tongue 20 which has two branched parts 23, joined by means of a hingelike folding line 25 to two parts 24 fixed in the opening means 9, which between them have a recess 26. A cross-section through the opening arrangements shown in FIG. 6 is represented in FIG. 7, wherein the same reference designations have been used as in FIG. 6. FIG. 7 shows the opening arrangement in its initial position wherein the front part 19 of the opening means 9 has been folded down against the package side. It is also evident from FIG. 7 that the pouring channel 6 has a "dented portion" 27 which is located above the fixing portion 21 and with the help of which the tongue 20 can be fixed to the opening area 4 of the packing container 1. The dented portion 27 in the pouring channel 6 should be dimensioned so that a tool can be introduced into the same, and so that it should be possible with the help of this tool to seal the front portion 21 of the tongue 20 to the top side of the packing container after the pouring channel 6 has been mounted.

Figure 8:
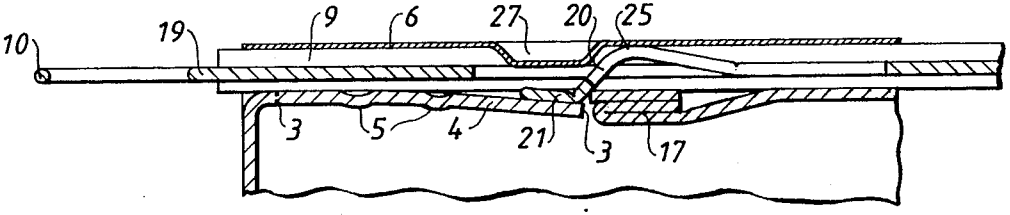
FIG. 8 shows how the opening in accordance with FIG. 7 is opened.

As is evident from FIG. 8 the opening procedure is initiated in that the front part of the opening means 9 comprising its pull-ring 10 is detached from the side wall of the packing container and raised. When the pull-ring 10 is pulled in the direction of the arrow, the opening means 9 will move to the left in the Figure. Since the inclinable means or the front part of the legs 20 is fixed to the upper side of the packages 1,1' along the hinged part 21 of the leg 20, the two legs 20 will be inclined in the manner shown in the Figur, the knee-joint 25 of the legs being pressed upwards against the upper end wall of the pouring channel 6. Because the legs 20 are being inclined in this manner, a compressive force will act upon the upper side of the packing container 1,1' close to the perforation 3, and when the compressive force on the part of the opening area 4, which is located below the hinged part 21 of the legs 20 becomes excessive, it causes the perforation 3 to break. When the perforation 3 has been broken in the manner described then, on continued pulling of the opening means 9 the package wall in the opening area 4, will be pressed into the packing container 1, 1', whilst the leg 20 continues to be inclined.

Figure 9:
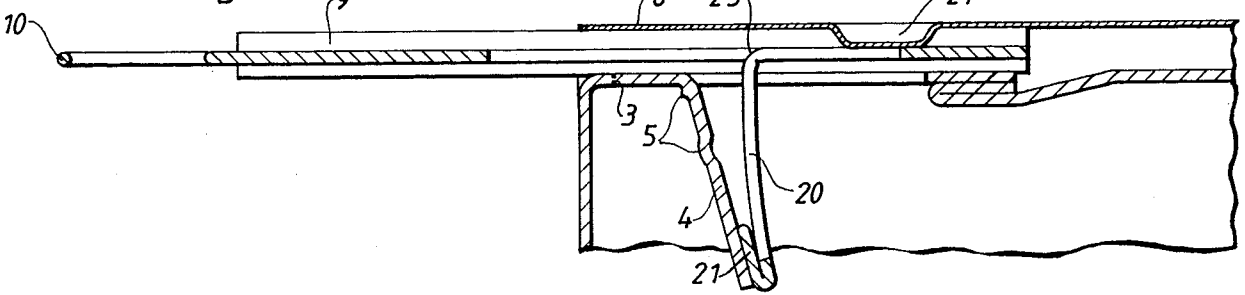
FIGS. 9, 10 and 11 show different stages of the opening operation.
Figure 10:
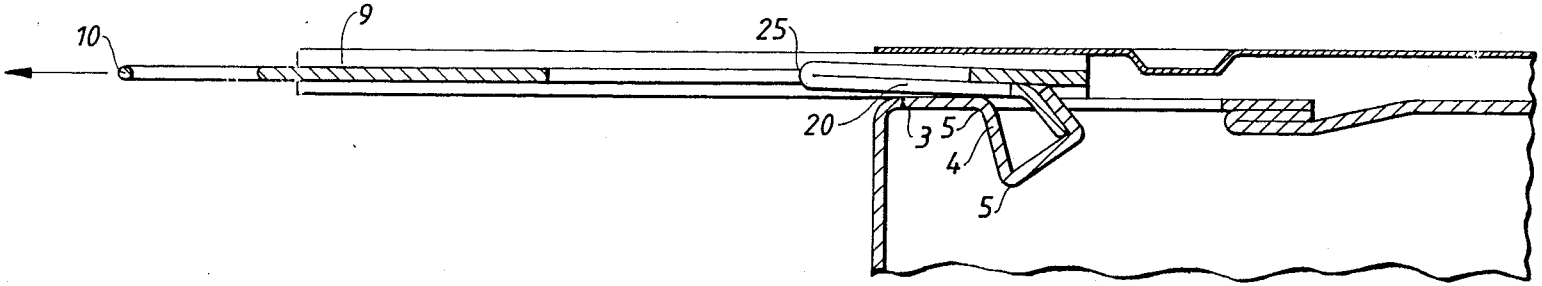
Figure 11:
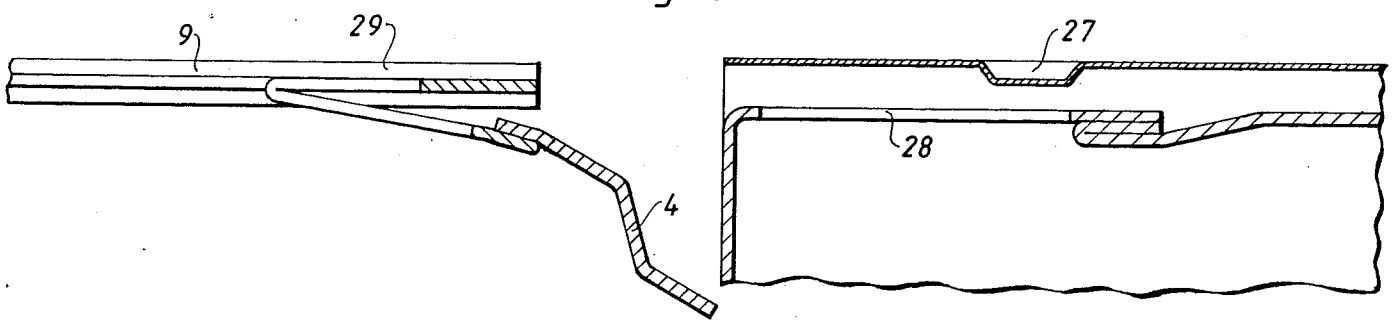

In FIG. 9 is shown how the inclinable part or the leg 20 has been completely folded back and has been pushed into the package so far that the knee-joint 25 is no longer pressed against the upper side of the pouring channel 6. As the pulling of the opening means 9 continues, the opening means 9, as shown in FIG. 10, will break a part of the upper side of the package which is located within the perforation 3, that is to say the part of the upper side of the package which forms the opening area 4. Since the hinged outer part 21 of the leg 20 on the opening means 9 is connected in an overlap joint to the package wall part 4 torn along the perforation line 3 it will be possible to tear out completely the packing material within the opening area 4, as shown in FIGS. 10 and 11, without any proper splitting forces being produced between the fixing part 21 of the oepning means 9 and the part of the package wall 4 which is attached to the said part of the opening means 9. In FIG. 11 is shown how the opening means 9 has been completely removed and how a free emptying opening 28 has been formed. The contents can be drained from the package 1, 1' in a convenient manner through the space 28 and the pouring channel 6.

As shown in Figures the opening means 9 may be injection moulded with one or more transverse flanges 29 and in a width which corresponds to, or is slightly less than, the inner height of the pouring channel 6. With the help of these flanges 29 the movement of the opening means 9 inside the pouring channel 6 can be controlled with great accuracy, which facilitates the opening operation. It should be noted too that the indentations 27 mentioned are located centrally and are arranged in such a manner that they can readily pass into the space 26 which is shown in FIG. 6 and which constitutes the space between the legs 20, 24.

By using the opening arrangement in accordance with the invention an opening operation can be carried out in a simple manner on applying a pulling movement, which on the one hand means that a compressive stress is applied to an area where it causes a perforation line to break, that the said perforation is torn up owing to the pressing in of the area delimited by the perforation, and that the tearing up to continued after the direction of pulling changed so that the whole area defined by perforation lines is torn away and removed together with the opening means used for performing the opening operation. At the same time a well-defined pouring channel is obtained, through which the contents of the package conveniently can be decanted. As mentioned in the description, it is also possible to combine the opening arrangement in accordance with the invention in such a manner that two or more joined packages can be opened at the same time in one and the same opening operation.

I claim:

1. An opening arrangement for a cardboard package of the type which has a package wall comprising a base layer of paper or cardboard having coatings of thermoplastic material on both sides and a tearing indication provided in the package wall enclosing at least parts of the desired opening area characterized by, on the one hand, a duct or pouring channel fixed to the said package wall, this pouring channel surrounding the said opening area so as to cover it, on the other hand a pull-out opening means arranged in the said pouring channel partially projecting from it and comprising parts which are inclinable in relation to the principal direction of the means and which are adapted so that with their one boundary edge they rest against, and are fixed to, the said opening area adjoining the tearing indication which delimits the opening area, and that the said opening means is adapted so that when a tensile force is exerted on the opened means substantially parallel with the longitudinal direction of the pouring channel, the said inclinable parts will be pressed in inclined position against the inside of the pouring channel and exert a pressure directed substantially against the package wall within the parts of the opening area where the said inclinable parts of the opening means are fixed, with the object of breaking up the said tearing indication and, on continued pulling out of the opening means from the pouring channel, remove the wall part or parts of the package wall present within the opening area after tearing up of the said tearing indication.

2. An opening arrangement in accordance with claim 1, characterized in that the said duct or pouring channel has two mutually preferably parallel side walls and an end wall bridging the side walls, and that it has a substantially U-shaped cross-section, the parallel legs of the U-section being substantially shorter than the web of the U-section which connects the said legs, that the said pouring channel is located so on the package wall that the free end edges of the side walls of the pouring channel or flanges or similar fixing means provided on these are attached to the surface of the package wall, that the end wall of the pouring channel which joins together these side walls is arranged substantially parallel with, and at some distance from, the said package wall, and that the said pouring channel is manufactured from a dimensionally relatively rigid material and/or is provided with stiffeners arranged in the wall surfaces of the pouring channel.

3. An opening arrangement in accordance with claim 1, characterized in that the opening means comprises a band arranged in the said pouring channel which is provided with one or more inclinable parts in the form of parts folded back or folds arranged on the band, each of the portions folded back in the fold being of a length which exceeds the height of the said pouring channel, and that the band along the tip of the said fold is fixed to the said opening area.

4. An opening arrangement in accordance with claim 3, characterized in that the band is dimensionally rigid in its longitudinal direction with the exception of the folding lines defined in the fold and/or that the said portions of the band folded back in the folds formed are provided with stiffening sections.

5. An opening arrangement in accordance with claim 1, characterized in that the opening means is constituted of a plate or dimensionally rigid band fitted into the pouring channel, wherein are arranged one or more tongues punched out or produced in some other manner which are adapted so as to form the said inclinable parts, the tip or front part of each of the said tongues being fixed to the said opening area in the package wall.

6. An opening arrangement in accordance with claim 5, characterized in that the front part of the said tongue which is fixed to a part of the said opening area is delimited by a hingelike folding line, which means that the said front portion of the tongue can be hinged in relation to the rest of the tongue.

7. An opening arrangement in accordance with claim 1, characterized in that the parts of the said opening area, wherein the said inclinable part is fixed, are delimited from the remaining parts of the opening area by means of a folding line extending over the opening area, which is oriented substantially at right angles to the longitudinal direction of the pouring channel.

8. An opening arrangement in accordance with claim 1, characterized in that the pouring channel is arranged over two or more packing containers assembled adjoining one another each having an opening area delimited by tearing indications, and that the opening means comprises a number of inclinable parts each of which being allocated, and fixed, to one of the opening areas of the said packing containers, with the object of uncovering by means of one opening operation the emptying openings of a number of packing containers connected to a common pouring channel.

9. An opening arrangement in accordance with claim 1, characterized in that the said tearing indication or indications which delimit the extent of the opening area is/are constituted of a tearing perforation which extends through the base layer of paper or cardboard of the passage wall, but not through its sealing inner plastic layer.

* * * * *